US009613615B2

(12) United States Patent
Nystrom

(10) Patent No.: US 9,613,615 B2
(45) Date of Patent: Apr. 4, 2017

(54) NOISE CANCELLATION SYSTEM, HEADSET AND ELECTRONIC DEVICE

(71) Applicant: Sony Mobile Communications Inc., Tokyo (JP)

(72) Inventor: Martin Nystrom, Horja (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 0 days.

(21) Appl. No.: 14/745,730

(22) Filed: Jun. 22, 2015

(65) Prior Publication Data

US 2016/0372104 A1 Dec. 22, 2016

(51) Int. Cl.
*G10K 11/178* (2006.01)
*H04R 1/10* (2006.01)

(52) U.S. Cl.
CPC ..... *G10K 11/1784* (2013.01); *G10K 11/1788* (2013.01); *H04R 1/10* (2013.01); *G10K 2210/506* (2013.01); *H04R 2460/01* (2013.01)

(58) Field of Classification Search
CPC ..... G10K 11/1784
USPC ..... 128/866; 379/391; 381/17, 71, 71.6, 92, 381/93, 312, 313, 315, 317, 325, 328, 381/355, 370, 71.14, 380, 391, 430; 455/569.1; 704/227
See application file for complete search history.

(56) References Cited

U.S. PATENT DOCUMENTS 5,251,263 A * 10/1993 Andrea ..... G10K 11/1784 381/71.6
5,448,637 A * 9/1995 Yamaguchi ..... H04M 1/05 379/430
7,466,838 B1 * 12/2008 Moseley ..... G10K 11/1788 381/370
8,447,045 B1 5/2013 Laroche
8,787,584 B2 * 7/2014 Nystrom ..... H04S 7/303 381/1
9,264,793 B2 * 2/2016 Brown ..... H04R 1/1091
2005/0157895 A1 * 7/2005 Lichtblau ..... H04R 25/405 381/312
2005/0249355 A1 11/2005 Chen
2008/0037801 A1 * 2/2008 Alves ..... G10L 21/02 381/71.6

(Continued)

OTHER PUBLICATIONS

International Search Report from counterpart International Patent Application No. PCT/EP2015/080756, mailed Feb. 25, 2016.

*Primary Examiner* — Gerald Gauthier
(74) *Attorney, Agent, or Firm* — Tucker Ellis LLP

(57) ABSTRACT

The present invention relates to a noise cancellation system, a headset and an electronic device. The noise cancellation system may include a loudspeaker, a first microphone, a second microphone, a housing and a processing unit. The housing may be mounted at an ear of a user, wherein the loudspeaker, the first microphone and the second microphone are installed in the housing. The processing unit may be coupled to the loudspeaker, the first microphone and the second microphone, and may be configured to generate a noise cancelling signal based on at least one of a first audio signal from the first microphone or a second audio signal from the second microphone, wherein the noise cancelling signal, when being output via the loudspeaker, at least partially compensates for environmental noise in the ear of the user.

18 Claims, 3 Drawing Sheets

(56) References Cited

U.S. PATENT DOCUMENTS

2008/0107282 A1* 5/2008 Asada ..... G10K 11/1782 381/71.14
2008/0112570 A1* 5/2008 Asada ..... G10K 11/1782 381/71.6
2008/0201138 A1* 8/2008 Visser ..... G10L 21/0208 704/227
2009/0003640 A1* 1/2009 Burnett ..... G10L 21/0208 381/355
2009/0010449 A1* 1/2009 Burnett ..... G10L 21/0208 381/92
2009/0010450 A1* 1/2009 Burnett ..... G10L 21/0208 381/92
2009/0010451 A1* 1/2009 Burnett ..... H04R 1/1091 381/92
2009/0290739 A1* 11/2009 Edwards ..... H04R 25/305 381/328
2010/0177904 A1* 7/2010 Sung ..... G10K 11/1788 381/71.6
2010/0260364 A1* 10/2010 Merks ..... H04R 25/407 381/313
2011/0014957 A1* 1/2011 Sugimori ..... H04R 1/1041 455/569.1
2012/0207322 A1* 8/2012 Burnett ..... H04R 1/406 381/92
2012/0230511 A1* 9/2012 Burnett ..... G10L 19/00 381/92
2012/0253798 A1 10/2012 Walters
2013/0315412 A1* 11/2013 Annunziato ..... G10K 11/16 381/71.6
2014/0153733 A1* 6/2014 Llewellyn ..... G10K 11/1788 381/71.6
2014/0311499 A1* 10/2014 Lee ..... G01R 33/288 128/866
2015/0043765 A1* 2/2015 Merks ..... H04R 25/407 381/317
2015/0078601 A1* 3/2015 Petersen ..... H04R 25/654 381/325
2015/0154950 A1 6/2015 Ring
2015/0172815 A1* 6/2015 Park ..... H04R 3/02 381/93
2015/0256660 A1* 9/2015 Kaller ..... H04M 1/585 379/391
2015/0382100 A1* 12/2015 Azmi ..... H04R 1/1091 381/380
2016/0088403 A1* 3/2016 Lambe ..... H04R 25/40 381/315
2016/0192089 A1* 6/2016 Merks ..... H04R 25/505 381/317

* cited by examiner

NOISE CANCELLATION SYSTEM, HEADSET AND ELECTRONIC DEVICE

BACKGROUND OF THE INVENTION

The present invention relates to a noise cancellation system, in particular to an active noise cancellation system which may be integrated into headphones or ear speakers and which implements a so-called feedback noise cancelling technique. The present invention relates furthermore to a headset and an electronic device realizing the noise cancellation system.

BRIEF SUMMARY OF THE INVENTION

According to an embodiment, a noise cancellation system comprises a loudspeaker, a first microphone, a second microphone and a housing in which the loudspeaker, the first microphone and the second microphone are integrated or installed. The housing is configured to be mounted at an ear of a user. For example, the housing may be configured to encompass an ear of the user at least partially, or the housing may be configured to be fitted directly in the outer ear, facing but not inserted in the ear canal, known as earphones. The noise cancellation system comprises furthermore a processing unit which is coupled to the loudspeaker, the first microphone and the second microphone. The processing unit is configured to generate a noise cancelling signal based on at least one of a first audio signal from the first microphone and a second audio signal from the second microphone. In other words, the processing unit generates the noise cancelling signal based on either the first audio signal or the second audio signal or on both, the first and the second audio signals. The noise cancelling signal at least partially compensates for environmental noise in the ear of the user when the noise cancelling signal is output via the loudspeaker. The noise cancelling system is configured such that the first microphone and the second microphone are located between the loudspeaker and an eardrum of the ear, when the housing is mounted at the ear of the user. Therefore, the first microphone and the second microphone receive audio signals which are present in the ear of the user, in particular in the ear canal of the user. Thus, the noise cancelling signal may be adjusted based on the noise recognized in the ear canal of the user.

Noise cancellation systems are gaining increasing popularity, in particular in combination with mobile devices being used in noisy environments, for example in a train, a car, a plane or a crowded place. Two different noise cancellation techniques are known, the feed forward noise cancelling and the feedback noise cancelling. The feed forward noise cancelling is a principle where a microphone is placed outside an earpiece. Signals from the environment are received with this outside microphone, are filtered and sent to the ear speaker in opposite phase for cancelling or reducing environmental noise. However, the feed forward noise cancelling principle is fixed from delivery and it will fit differently to different users depending on an individual size of an ear canal of the respective user. Furthermore, the noise cancelling capabilities of the feed forward noise cancelling depend on how the earpiece is inserted into the outer ear and seals the ear from environmental noise. The feedback noise cancelling utilizes an inner microphone arranged in or near the ear canal which captures audio signals present in the ear canal. Parameters of the feed forward noise cancelling may be updated based on information of the residual noise in the ear canal captured by the inner microphone in the ear canal.

However, the inner or in-ear microphone may not represent pressure at the eardrum when acoustic standing wave patterns occur in the ear canal. This may limit the efficiency and performance of the feedback noise cancelling. By using the first microphone and second microphone as described in the embodiment above, also in case of acoustic standing wave patterns or resonance conditions in the ear canal, noise conditions at the eardrum can be reliably determined from audio signals from the first and second microphones. Therefore, reliability and efficiency of the feedback noise cancelling may be improved.

According to an embodiment, the noise cancellation system is configured such that the first microphone and the second microphone are located within an ear canal of the ear or at a distal end of the ear canal, when the housing is mounted at the ear of the user. Furthermore, when the housing is mounted at the ear of the user, the loudspeaker may be located at an auricle of the ear or in an ear canal of the ear. For example, the housing may comprise a housing in the form of traditional earphones, so-called earbuds, or in-ear headphones.

According to another embodiment, the noise cancellation system comprises a third microphone which is coupled to the processing unit and which is installed in the housing such that the third microphone receives environmental noise directly from an outside environment. For example, the first microphone and the second microphone are arranged at a first side of the loudspeaker, and the third microphone is arranged at a second side of the loudspeaker opposite to the first side. When the loudspeaker is arranged for example at an auricle and emits acoustic waves into the direction of the ear canal, the first and second microphone may be arranged between the loudspeaker and the ear canal, whereas the third microphone is arranged at the opposite side of the loudspeaker such that the loudspeaker is arranged between the third microphone and the ear canal. The third microphone is coupled to the processing unit, and the processing unit is configured to generate the noise cancelling signal additionally based on a third audio signal from the third microphone. Thus, the processing unit may combine a feed forward noise cancelling based on the third audio signal and adapt the noise cancelling by a feedback noise cancelling based on the first and second audio signals from the first and second microphones.

Acoustic waves are a type of longitudinal waves that propagate in a media, e.g. air, by means of adiabatic compression and decompression. In gases, like air, the acoustic waves are longitudinal waves. This means that the vibration displacement of the particles is parallel to the propagation direction. Important quantities for describing acoustic waves are for example sound pressure, particle velocity, particle displacement and sound intensity. The sound pressure and the particle velocity vary periodically as a function of the frequency. In resonance conditions, sound pressure and particle velocity may each form a corresponding standing wave. However, the standing wave of the sound pressure and the standing wave of the particle velocity are out of phase, e.g. phase shifted by 90 degrees. This means for example that at a certain position the standing wave of the sound pressure has a node (i.e. a maximum variation in pressure) whereas the standing wave of the particle velocity has an antinode (minimum or no variation in velocity) at this position. Vice versa, at another position the standing wave of the sound pressure may have an antinode and the standing wave of the particle velocity may have a node. There are two types of microphones: a pressure sensing microphone which is sensitive to the sound pressure, and a pressure gradient sensing microphone which is sensitive to the pressure gradient. Pressure gradient sensing microphones are also called directional or velocity sensitive microphones.

In some embodiments the first microphone is a sound pressure sensing microphone and the second microphone is also a sound pressure sensing microphone. Additionally, the first microphone may be arranged at a first distance from the loudspeaker and the second microphone may be arranged at a second distance from the loudspeaker, wherein the first distance and the second distance are different. In resonance cases which may occur in the ear canal, one of the first and second microphones may be arranged at a wave node of the sound pressure and may therefore be incapable of receiving noise signals for performing a corresponding feedback noise cancelling. However, due to the different distances from the loudspeaker, the other microphone of the first and second microphones will be arranged outside the wave node such that the feedback noise cancelling may be performed reliably under resonance conditions also.

In some other embodiments the first microphone is a sound pressure sensing microphone and the second microphone is a sound pressure gradient sensing microphone. In this case the first microphone and the second microphone may be arranged at the same distance from the loudspeaker. In case of resonance conditions, the first microphone may be arranged at a wave node of the sound pressure and may therefore be incapable of receiving noise signals for performing a corresponding feedback noise cancelling. However, as the second microphone is sensing a sound pressure gradient, the second microphone will detect the noise signal based on a pressure gradient or particle velocity although it is arranged at the wave node of the sound pressure. In a resonance condition where the second microphone is arranged at an antinode of the sound pressure where the pressure gradient sensing microphone will not detect any noise signals, the first microphone will detect a large amplitude at the antinode and will therefore deliver a sound signal suitable for the feedback noise cancelling.

To sum up, in some embodiments two pressure sensitive microphones may be located at different distances or positions, and in some other embodiments a combination of a pressure sensitive microphone and a pressure gradient sensitive microphone may be located at the same position. Furthermore, in some embodiments two pressure gradient sensitive microphones may be located in the same position if they are directed in opposite directions, or could be at two different positions.

According to another embodiment a headset comprises a loudspeaker, a first microphone, a second microphone and a housing configured to be mounted at an ear of a user. The loudspeaker, the first microphone and the second microphone are installed in the housing. The headset is configured such that the first microphone and the second microphone are located between the loudspeaker and an eardrum of the ear of the user, when the housing is mounted at the ear of the user. The headset may be coupled to an electronic device, for example a music playback device or a mobile telephone, and the electronic device may use audio signals from the first microphone and the second microphone to perform a feedback noise cancelling which works reliably even in resonance conditions.

The headset may comprise additionally an input for receiving an audio input signal to be output by the headset to the user, and a processing unit coupled to the loudspeaker, the audio input, the first microphone, and the second microphone. The processing unit may be configured to generate a noise cancelling signal based on at least one of a first audio signal from the first microphone and a second audio signal from the second microphone, to generate an audio output signal comprising the audio input signal and the noise cancelling signal, and to output the audio output signal via the loudspeaker. The noise cancelling signal at least partially compensates for environmental noise in the ear of the user when the audio output signal is output via the loudspeaker. By integrating the processing unit into the headset, a noise cancelling functionality may be provided by the headset in combination with an arbitrary audio source, for example a music playback device or a mobile telephone.

In another embodiment an electronic device comprises a connector for coupling the electronic device to a headset, an audio input for receiving an audio input signal to be output by the headset to a user, and a processing unit coupled to the connector. The headset comprises a loudspeaker, a first microphone, a second microphone and a housing configured to be mounted at an ear of the user. The loudspeaker, the first microphone and the second microphone are installed in the housing. The headset is configured such that the first microphone and the second microphone are located between the loudspeaker and an eardrum of the ear of the user, when the housing is mounted at the ear of the user. Therefore, the first microphone and the second microphone may capture audio signals within an ear canal of the ear of the user. The processing unit receives a first audio signal from the first microphone and a second audio signal from the second microphone via the connector. Based on at least one of the first audio signal and the second audio signal the processing unit generates a noise cancelling signal. The processing unit receives an audio input signal, for example a music or speech signal to be output to the user, via the audio input. The processing unit generates an audio output signal comprising the audio input signal and the noise cancelling signal, and outputs the audio output signal to the loudspeaker via the connector. The noise cancelling signal at least partially compensates for environmental noise in the ear of the user when being output via the loudspeaker. The electronic device comprises for example a mobile telephone, a mobile music playback device, a mobile gaming device, a computer or a tablet computer. As these electronic devices in general comprise a powerful processing unit, this processing unit may be used during audio output for generating the noise cancelling signal. Thus, additional cost for a processing unit to be integrated into the headset for generating the noise cancelling signal may be avoided.

Although specific features described in the above summary and in the following detailed description are described in connection with specific embodiments, it is to be understood that the features of the embodiments described above may be combined with each other unless specifically noted otherwise.

BRIEF DESCRIPTION OF THE DRAWINGS

The present invention will now be described in more detail with reference to the accompanying drawings.

BRIEF DESCRIPTION OF PREFERRED EMBODIMENTS

In the following, exemplary embodiments of the present invention will be described in more detail. It is to be understood that the features of the various exemplary embodiments described herein may be combined with each other unless specifically noted otherwise. Any coupling between components or devices shown in the figures may be a direct or indirect coupling unless specifically noted otherwise. Same reference signs in the various drawings refer to similar or identical components.

Noise cancellation, also known as active noise control or active noise reduction, is a method for reducing unwanted sound by the addition of a sound specifically designed to cancel the unwanted sound. Sound is a pressure wave which consists of a compression phase and a rarefaction phase. A loudspeaker of a noise cancellation system emits a sound wave with the same amplitude but with inverted phase to the unwanted sound. The waves of the emitted sound wave and the unwanted sound combine to form a new wave in a process called interference, and actively cancel each other out. A noise cancellation system may be integrated in a headset to reduce environmental noise when the user of the headset is listening to speech or music. The noise cancelling sound waves may be emitted together with the speech or music by a loudspeaker of the headset.

Figure 1:
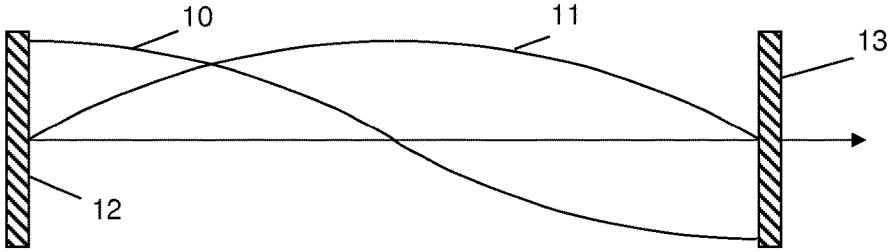
FIGS. 1-3 show basic principles of acoustic resonances.
Figure 2:
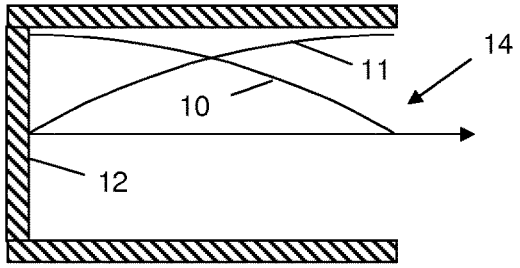
Figure 3:
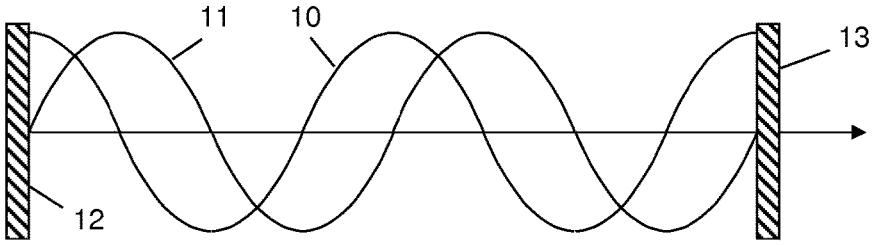

For generating a noise cancelling signal, which interferes with the noise when being output as a sound wave by a loudspeaker, a microphone may receive environmental noise which may be processed to generate the noise cancelling signal. In a headset, the microphone for receiving the environmental noise may be placed outside an ear piece of the headset. Signals from this outside microphone may be filtered and sent to the loudspeaker or ear speaker in opposite phase for cancellation or reduction of noise received by a user wearing the headset. This principle is known as feed forward noise cancelling. The feed forward noise cancelling takes the acoustic environment and a users ear into account, but it can not adapt. The design is a compromise of best fit for some standard users. An improved noise cancellation system may therefore utilize not only the microphone at the outside of the earpiece, but also a microphone in or near the ear canal of the user, a so-called inner microphone. Such a noise cancellation system is also called feedback noise cancellation system. For example, based on information of the residual unwanted noise in the ear canal captured by the inner microphone, the feed forward noise cancellation may be updated. However, the audio signal received at the inner microphone may not represent an audio signal received at an eardrum of the user when acoustic standing waves occur in the ear cancel, for example due to resonance effects. This may limit the quality of the feedback noise cancelling. The basic principles of acoustic resonances are illustrated in FIGS. 1-3. FIG. 1 shows a pressure magnitude 10 and a particle velocity magnitude 11 of an audio signal travelling between a first rigid boundary 12 and a second rigid boundary 13. Pressure 10 and particle velocity 11 are out of phase. Depending on the wavelength of the audio signal, resonances may occur between the first and second boundaries 12, 13. For rigid boundary conditions at both ends shown in FIG. 1, resonances will occur at a multiple of half wavelengths of the audio signal. FIG. 2 shows resonances for a rigid boundary 12 and an open boundary 13. Resonances will be multiples of half wavelengths plus a quarter wavelength. FIG. 3 shows higher order resonance for rigid boundaries 12, 13.

Figure 4:
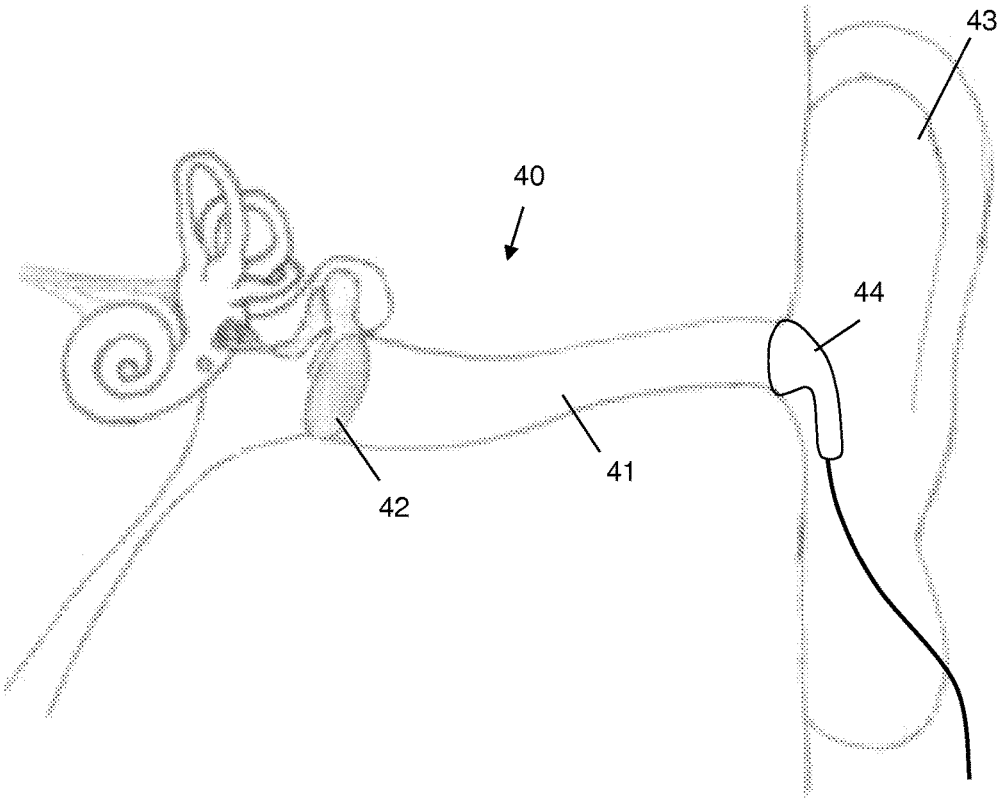
FIG. 4 shows an ear canal system in connection with a headset according to an embodiment of the present invention.

The human ear canal system may approximately be handled as a tube with a more or less rigid boundary condition at the proximal end, the eardrum. FIG. 4 shows schematically a human ear 40 in a sectional view. The ear 40 comprises an ear canal 41 extending from the proximal end where the eardrum 42 is located to a distal end at an auricle 43. The distal or outer end of the ear canal 41 is more or less open, unless an earphone or earbud 44 is plugged into the auricle 43. Depending on the type of ear speaker used in the earphone 44, different boundary conditions at the distal end of the ear canal 41 may occur. A bone or pinna conducting transducer arranged spaced apart from the auricle will result in an open distal end of the ear canal 41. An earphone arranged in the auricle but spaced apart from the ear canal 41 results in an acoustically quite leaky coupling of the earphone and the ear canal 41 and will result therefore in something between an almost open to semi-closed condition at the distal end of the ear canal 41. An in-ear speaker arranged in closed proximity to the ear canal 41 results in a closed or semi-closed boundary condition at the distal end of the ear canal 41.

Figure 5:
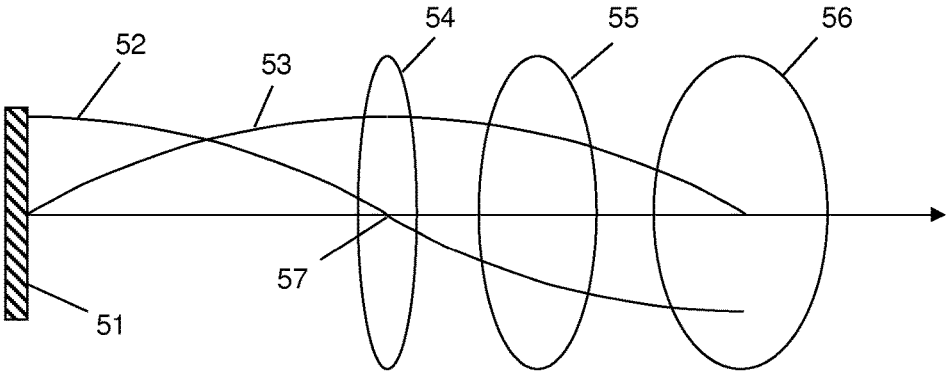
FIG. 5 shows acoustic resonances in the ear canal of FIG. 4.

FIG. 5 shows the different resonance conditions resulting from the different arrangements of the earphone 44 with respect to the ear 40. A rigid boundary 51 represents the eardrum 42 at the proximal end of the ear canal 41. Furthermore, a pressure magnitude 52 and a particle velocity 53 of ear canal resonances are shown in FIG. 5. Depending on the type and arrangement of the earphone 44, different resonance boundary conditions may occur as indicated in FIG. 5 by reference signs 54-56. The pinna or bone conducting transducer results in resonances at wavelengths having multiples of half wavelengths plus a quarter wavelength as shown by reference sign 54. The in-ear speaker providing a rigid distal end of the ear canal 41 will have resonances when multiples of half wavelengths of the audio signal matches the distance between the eardrum 42 and the position of the in-ear speaker as indicated by reference sign 56. For earphones arranged in the auricle, a resonance may occur between these two conditions 54 and 56 as indicated by reference sign 55 in FIG. 5.

Additionally to this basic resonance behavior of the ear canal, resonances may be influenced also by Helmholtz resonator effects due to the air enclosed in the ear canal 41 and leakage thereof at the distal end of the ear canal 41. The leakage may vary each time the earphone is inserted into the ear 40. Therefore, in practice, the combination of the ear 40 and the earphone 44 is a complex resonant system.

For realizing the above-described feedback noise cancelling principle, a microphone may be placed inside or near the distal end of the ear canal 41 within the earphone 44. The microphone may be of a pressure sensing type such that the audio signal from the microphone is a function of the pressure 52. For non-resonant system conditions the pressure will vary in time dependent on sound pressure level and frequency. However, in resonant system conditions, the pressure variations in time may vary differently from one point to another point. A worst case is for example, when the pressure varies at the eardrum 42 at a maximum, but the microphone is placed in a node 57 where the pressure is almost zero due to resonances. When such a microphone is used in a feedback noise cancellation system, the noise cancelling performance may be very limited in resonance conditions. Usage of a pressure gradient sensing microphone will not solve the problem in general, but simply shift the problem to other frequencies.

Figure 6:
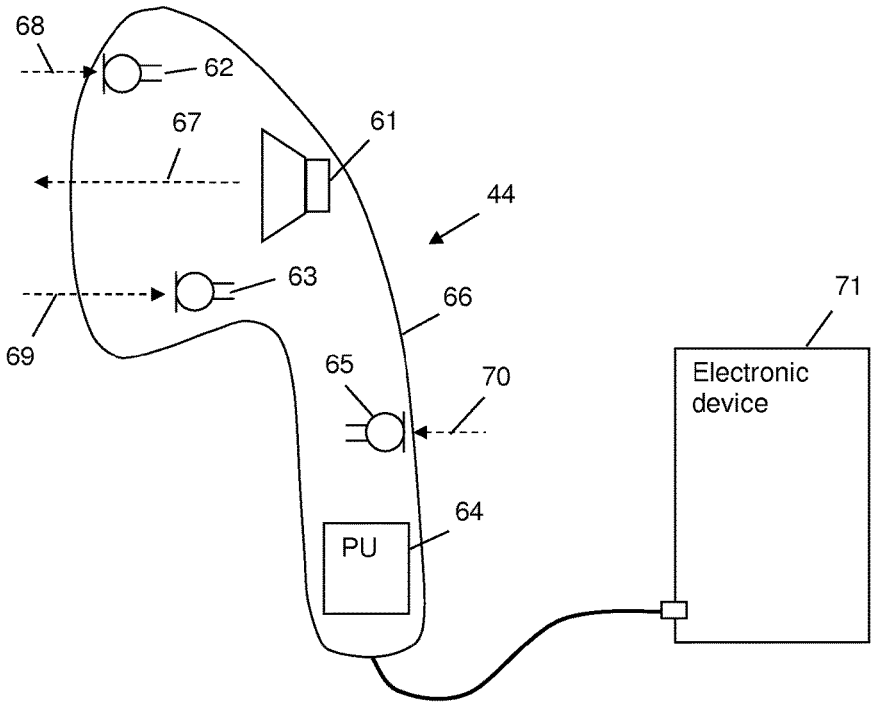
FIG. 6 shows schematically a noise cancellation system comprising a headset and an electronic device according to an embodiment of the present invention.

For avoiding limitations of the feedback noise cancellation in resonance conditions, FIG. 6 shows an earphone 44 comprising an ear speaker or loudspeaker 61, a first microphone 62, a second microphone 63, a third microphone 65 and a processing unit 64. The above-listed components are comprised in a common housing 66 which is configured to be mounted at an ear of a user as shown in FIG. 4. The processing unit 64 is coupled to the loudspeaker 61, the first microphone 62, the second microphone 63 and the third microphone 65. The loudspeaker 61 is arranged such that an audio output 67 is directed into the ear canal 41 of the ear 40 at which the earphone 44 is mounted. The first microphone 62 is configured to receive a first audio signal 68 which is present in the audio canal 41. The second microphone 63 is configured to receive a second audio signal 69 present in the audio canal 41. The third microphone 65 is arranged such in the housing 66 that it may receive a third audio signal 70 present at an outer environment of the ear 40 at which the earphone 44 is mounted. The third audio signal 70 from the third microphone 65 is used by the processing unit 64 to generate a feed forward noise cancelling signal which is output by the loudspeaker 61. The first microphone 62 and the second microphone 63 are arranged between the eardrum 42 and the loudspeaker 61 such that the first microphone 62 and the second microphone 63 receive audio signals inside the ear canal 41 emitted by the loudspeaker 61. The first and second microphones 62 and 63 are placed along a longitudinal axis of the ear canal 41 so that they have different distances to the axial boundaries of the ear canal 41. The vertical spacing shown in FIG. 6 between the first and second microphones 62 and 63 is only for clarity of the drawing. In a practical implementation, the first microphone 62 and the second microphone 63 (and also the loudspeaker 61) may be arranged essentially along an axis in the ear canal direction. Due to the different distances to the axial boundaries of the ear canal 41, even in resonance conditions at least one of the first microphone 62 and the second microphone 63 may receive an audio signal which corresponds to the audio signal received at the eardrum 42. Therefore, even under resonance conditions, a feedback noise cancellation signal can be generated by the processing unit 64 based on the first and/or the second audio signal from the first microphone 62 and the second microphone 63, respectively. The processing unit 64 may receive from the electronic device 71 an audio signal comprising speech or music which is to be output to a user. The audio signal received from the electronic device 71 may be mixed by the processing unit 64 with the generated noise cancelling signal and output via the loudspeaker 61 into the ear 40 of the user. Beside the improved handling of resonances, the arrangement of two microphones 62, 63 in or near the ear canal 41 may help to improve the noise cancelling in general, for example by reducing a tendency to oscillations.

Figure 7:
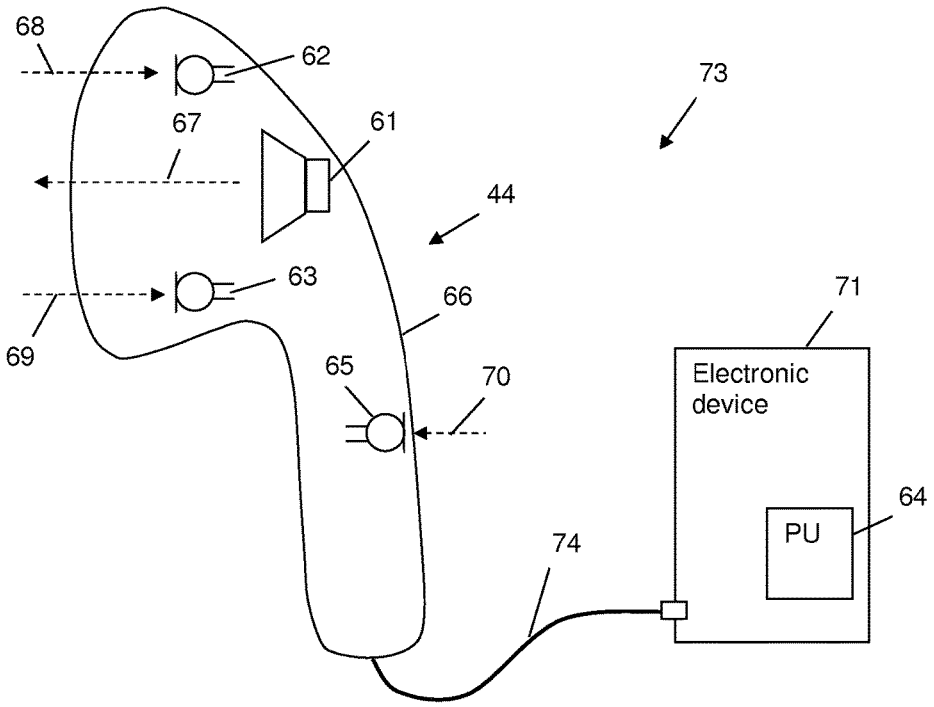
FIG. 7 shows schematically a noise cancellation system comprising a headset and an electronic device according to another embodiment of the present invention.

FIG. 7 shows another embodiment utilizing two microphones 62, 63 receiving in-ear audio signals 68 and 69 for generating a feedback noise cancelling signal. However, compared to the earphone 44 of FIG. 6, in the earphone 44 of FIG. 7 the first microphone 62 and the second microphone 63 are arranged at a same position along the axis of the ear canal 41. Therefore, for avoiding that both microphones 62 and 63 are influenced by a resonance condition at the same time, one of the microphones 62, 63 is a pressure sensitive microphone and the other microphone of the microphones 62, 63 is a pressure gradient sensing microphone. For example, the first microphone 62 comprises a pressure sensitive microphone and the second microphone 63 comprises a gradient pressure sensing microphone. In case both microphones 62, 63 are arranged at node position 57 of FIG. 5 in a resonance condition, the pressure sensing microphone 62 may almost receive nothing whereas the gradient pressure sensing microphone 63 will detect the significant gradient pressure present at node 57. Therefore, a noise cancellation may be reliably performed even under resonance conditions based on the first audio signal from the pressure sensing microphone 62 and on the second audio signal from the gradient pressure sensing microphone 63. The gradient pressure sensing microphone may have a directional receiving characteristic, for example a cardioid receiving characteristic, improving a gain of the audio signals received from the ear canal 41. As already noted in connection with FIG. 6, the vertical spacing shown in FIG. 7 between the first and second microphones 62 and 63 is only for clarity of the drawing. In a practical implementation, the first microphone 62 and the second microphone 63 (and also the loudspeaker 61) may be arranged essentially along an axis in the ear canal direction.

The processing of the audio signals received by the in-ear microphones 62, 63 and the third microphone 65 may be performed by the processing unit 64 which is arranged in the embodiment shown in FIG. 7 in the electronic device 71. The processing unit 64 receives the audio signals from the microphones 62, 63 and 65 via a connection 74 between the earphone 44 and the electronic device 71. The processing unit 64 generates the noise cancelling signal based on the received audio signals from the microphones 62, 63 and 65, and generates an audio output signal comprising the noise cancelling signal and a music or speech signal which is to be output to the ear 40 of a user.

As can be seen from FIGS. 6 and 7, a noise cancellation system may be completely integrated into an earphone 44 as shown in FIG. 6, or may be cooperatively implemented in the earphone 44 and the electronic device 71 as shown in FIG. 7.

What is claimed is:

1. A noise cancellation system, comprising:

a loudspeaker, a first microphone and a second microphone, a housing configured to be mounted at an ear of a user, wherein the loudspeaker, the first microphone and the second microphone are installed in the housing, and a processing unit coupled to the loudspeaker, the first microphone and the second microphone, and configured to generate a noise cancelling signal based on at least one of a first audio signal from the first microphone and a second audio signal from the second microphone, wherein the noise cancelling signal, when being output via the loudspeaker, at least partially compensates for environmental noise in the ear of the user, and wherein the noise cancellation system is configured such that, when the housing is mounted at the ear of the user, the first microphone and the second microphone are located between the loudspeaker and an eardrum of the ear, and wherein the noise cancelling signal is a feedback noise cancelling signal.

2. The noise cancellation system according to claim 1, wherein the processing unit is configured to generate the noise cancelling signal based on the first audio signal and the second audio signal.

3. The noise cancellation system according to claim 1, wherein the noise cancellation system is configured such that, when the housing is mounted at the ear of the user, the first microphone and the second microphone are located within an ear canal of the ear.

4. The noise cancellation system according to claim 1, wherein the noise cancellation system is configured such that, when the housing is mounted at the ear of the user, the loudspeaker is located at an auricle of the ear or in an ear canal of the ear.

5. The noise cancellation system according to claim 1, comprising:

a third microphone coupled to the processing unit and installed in the housing, wherein the processing unit is configured to generate the noise cancelling signal additionally based on a third audio signal from the third microphone, wherein the first microphone and the second microphone are arranged at a first side of the loudspeaker, and the third microphone is arranged at a second side of the loudspeaker opposite to the first side.

6. The noise cancellation system according to claim 5, wherein the noise cancellation system is configured such that, when the housing is mounted at the ear of the user, the third microphone is located outside the ear canal of the ear.

7. The noise cancellation system according to claim 1, wherein the first microphone is a sound pressure sensing microphone and the second microphone is a sound pressure sensing microphone.

8. The noise cancellation system according to claim 7, wherein the first microphone is arranged at a first distance from the loudspeaker and the second microphone is arranged at a second distance from the loudspeaker, the first distance and the second distance being different.

9. The noise cancellation system according to claim 1, wherein the first microphone is a sound pressure sensing microphone and the second microphone is a sound pressure gradient sensing microphone.

10. The noise cancellation system according to claim 9, wherein the first microphone is arranged at a first distance from the loudspeaker and the second microphone is arranged at a second distance from the loudspeaker, the first distance and the second distance being equal.

11. The noise cancellation system according to claim 1, wherein the first and second microphones are arranged relative to the loudspeaker and the ear drum of the user so that the feedback noise cancelling signal is effective to at least partially compensate for an acoustic wave comprising the environmental noise in the ear of the user when the at least one of the first microphone or the second microphone are located at a node of a standing wave of a sound pressure of the acoustic wave or a node of a standing wave of a particle velocity of the acoustic wave.

12. The noise cancellation system according to claim 8, wherein the first and second microphones are arranged relative to the loudspeaker and the ear drum of the user so that the feedback noise cancelling signal is effective to at least partially compensate for an acoustic wave comprising the environmental noise in the ear of the user when one of the first microphone or the second microphone is located at a node of a standing wave of a sound pressure of the acoustic wave.

13. The noise cancellation system according to claim 10, wherein the first and second microphones are arranged relative to the loudspeaker and the ear drum of the user so that the feedback noise cancelling signal is effective to at least partially compensate for an acoustic wave comprising the environmental noise in the ear of the user when the first microphone is located at a node of a standing wave of a sound pressure of the acoustic wave and when the second microphone is located at a node of a standing wave of a particle velocity of the acoustic wave.

14. A headset comprising:

a loudspeaker, a first microphone and a second microphone, a housing configured to be mounted at an ear of a user, wherein the loudspeaker, the first microphone and the second microphone are installed in the housing, an audio input for receiving an audio input signal to be output by the headset to the user, and a processing unit coupled to the loudspeaker, the audio input, the first microphone and the second microphone, and configured to generate a noise cancelling signal based on at least one of a first audio signal from the first microphone and a second audio signal from the second microphone, to generate an audio output signal comprising the audio input signal and the noise cancelling signal, and to output the audio output signal via the loudspeaker, and wherein the headset is configured such that, when the housing is mounted at the ear of the user, the first microphone and the second microphone are located between the loudspeaker and an eardrum of the ear, and wherein the noise cancelling signal is a feedback noise cancelling signal and, when being output via the loudspeaker, at least partially compensates for environmental noise in the ear of the user.

15. The headset according to claim 14, wherein the first and second microphones are arranged relative to the loudspeaker and the ear drum of the user so that the feedback noise cancelling signal is effective to at least partially compensate for an acoustic wave comprising the environmental noise in the ear of the user when the at least one of the first microphone or the second microphone are located at a node of a standing wave of a sound pressure of the acoustic wave or a node of a standing wave of a particle velocity of the acoustic wave.

16. An electronic device, comprising:

a connector for coupling the electronic device to a headset, the headset comprising a loudspeaker, a first microphone, a second microphone, and a housing configured to be mounted at an ear of a user, wherein the loudspeaker, the first microphone and the second microphone are installed in the housing, wherein the headset is configured such that, when the housing is mounted at the ear of the user, the first microphone and the second microphone are located between the loudspeaker and an eardrum of the ear, an audio input for receiving an audio input signal to be output by the headset to the user, and a processing unit coupled to the connector and configured to generate a noise cancelling signal based on at least one of a first audio signal from the first microphone and a second audio signal from the second microphone, to generate an audio output signal comprising the audio input signal and the noise cancelling signal, and to output the audio output signal to the loudspeaker, and wherein the noise cancelling signal is a feedback noise cancelling signal and, when being output via the loudspeaker, at least partially compensates for environmental noise in the ear of the user.

17. The electronic device according to claim 16, wherein the electronic device comprises at least one of a group consisting of:

a mobile telephone, a mobile music playback device, a mobile gaming device, a computer, and a tablet computer.

18. The electronic device according to claim 16, wherein the first and second microphones are arranged relative to the loudspeaker and the ear drum of the user so that the feedback noise cancelling signal is effective to at least partially compensate for an acoustic wave comprising the environmental noise in the ear of the user when the at least one of the first microphone or the second microphone are located at a node of a standing wave of a sound pressure of the acoustic wave or a node of a standing wave of a particle velocity of the acoustic wave.

* * * * *